US008297572B2

(12) United States Patent
Fox

(10) Patent No.: US 8,297,572 B2
(45) Date of Patent: Oct. 30, 2012

(54) HANGING FIXTURE FOR WALL BOARD AND METHOD FOR ITS USE

(75) Inventor: Andrew C. Fox, Kansas City, KS (US)

(73) Assignee: Andrew C. Fox, Kansas City, KS (US)

( * ) Notice: Subject to any disclaimer, the term of this patent is extended or adjusted under 35 U.S.C. 154(b) by 207 days.

(21) Appl. No.: 12/420,611

(22) Filed: Apr. 8, 2009

(65) Prior Publication Data

US 2009/0256041 A1 Oct. 15, 2009

Related U.S. Application Data

(60) Provisional application No. 61/043,252, filed on Apr. 8, 2008.

(51) Int. Cl.
*E04G 3/00* (2006.01)
*F21V 21/00* (2006.01)

(52) U.S. Cl. ..... 248/220.31; 248/221.11; 248/222.51; 248/222.52; 248/224.8; 248/235

(58) Field of Classification Search ..... 248/220.31, 248/222.11, 304, 222.12
See application file for complete search history.

(56) References Cited

U.S. PATENT DOCUMENTS

| | | | | |
|---|---|---|---|---|
| 4,341,486 | A * | 7/1982 | Hammerschlag | 403/252 |
| 4,506,856 | A * | 3/1985 | Rich et al. | 248/220.31 |
| 4,796,541 | A * | 1/1989 | Halstrick | 108/107 |
| 6,186,455 | B1 * | 2/2001 | Hollingsworth et al. | 248/220.31 |
| 6,591,995 | B1 * | 7/2003 | Grove | 211/87.01 |
| 2003/0183735 | A1 * | 10/2003 | Moerke et al. | 248/220.31 |

* cited by examiner

*Primary Examiner* — Amy J Sterling
(74) *Attorney, Agent, or Firm* — Shook, Hardy & Bacon L.L.P.

(57) ABSTRACT

An apparatus for insertion into a board having a slot to enable items to be hung thereon and its method of use is disclosed. The apparatus has a body; an arm that extends for a desired length from the body; and an upper and a lower leg each having an arcuate distal edge. The upper leg and lower leg extending generally longitudinally outwardly from the body in an opposite direction from the arm and are in spaced relation. The upper leg comprises an upwardly extended finger located at the distal end of the upper leg having a shoulder spaced from the longitudinal length of the upper leg.

7 Claims, 2 Drawing Sheets

HANGING FIXTURE FOR WALL BOARD AND METHOD FOR ITS USE

CROSS-REFERENCE TO RELATED APPLICATIONS

This application claims the benefit of and priority to U.S. Provisional Application Ser. No. 61/043,252, filed on Apr. 8, 2008, which is hereby incorporated by reference in its entirety.

BACKGROUND OF THE INVENTION

Perforated hardboard, such as pegboard, is a board predrilled with evenly spaced holes. It can be mounted on a wall and the holes are used to accept metal pegs to support various items. The holes may be circular or formed as a slot. There are a large variety of connectors which are designed to engage the holes in the pegboard and to provide hooks or brackets for attaching other devices. For example, simple hooks are available that have a first end that goes through one of the holes in the wood pegboard with the other end extending downwardly along the pegboard and then curving out away from the pegboard. The hook may also have an additional peg on the back that engages a second hole in order to stabilize the hook. Any of a variety of objects may be hung on the hook. Because the pegboard has a plurality of holes at regular intervals, the hook may be placed in any of a multitude of positions, making for easy organization.

Typically, the pegs or other connectors for use with perforated hardboard are not securely held in place in the pegboard. Further, most of the connectors are preformed and made of metal and thus they are relatively expensive to ship.

SUMMARY OF THE INVENTION

The present invention provides an apparatus for insertion into a board having a slot to enable items to be hung thereon. The apparatus comprises a body; an arm that extends for a desired length from the body; and an upper and a lower leg each having an arcuate distal edge. The upper leg and lower leg extending generally longitudinally outwardly from the body in an opposite direction from the arm and are in spaced relation. The upper leg comprises an upwardly extended finger located at the distal end of the upper leg having a shoulder spaced from the longitudinal length of the upper leg.

In another aspect of the present invention, a method for inserting an apparatus into a board for use in hanging objects from the apparatus is disclosed. The method comprises the steps of providing an apparatus having a pair of legs extending in one direction and at least one arm extending in an other direction, the pair of legs having an arcuate distal edge. The upper leg further comprising a finger that defines a notch, the finger being operably configured to fit into a slot of the board. The method further includes the steps of inserting the finger of the apparatus into the slot and rotating the apparatus such that the arm of the apparatus starts at an upper position and is lowered to a position that is approximately perpendicular to the board; and locking the apparatus by bending a portion of the legs of the apparatus.

BRIEF DESCRIPTION OF THE DRAWINGS

The invention will be readily understood by the following description of certain embodiments by way of example, in conjunction with the accompanying drawings in which.

DETAILED DESCRIPTION OF THE INVENTION

Figure 1:
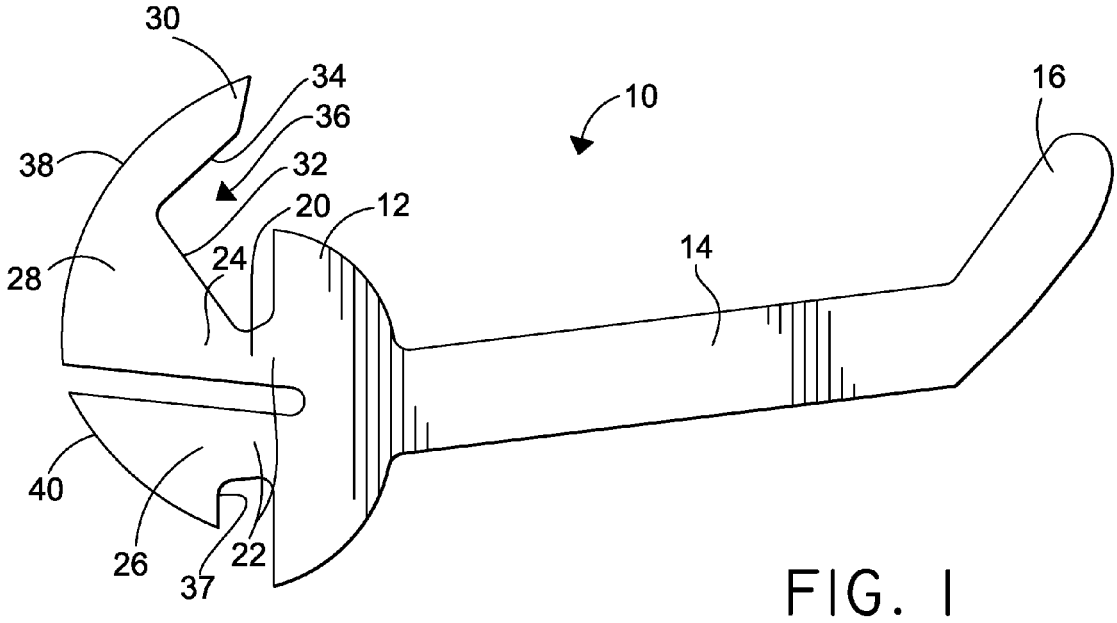
FIG. 1 is a side elevational view of the hanging apparatus in accordance with the present invention.

As shown in FIG. 1, a hanging apparatus of the present invention is shown generally at 10. The hanger 10 comprises a body 12, an arm 14 extending longitudinally outwardly from the body, and a pair of anchoring legs 20 extending generally longitudinally outwardly from the body in an opposite direction from the arm 14. The hanger 10 is preferably made of plastic and is sufficiently pliable to be bent into different configurations as will be explained in greater detail hereinafter.

The arm 14 extends for a desired length from the body 12 of the hanger 10. The arm 14 preferably terminates in a hook 16 or other upwardly extending configuration to aid in retaining objects on the arm 14.

The anchoring legs 20 extend from the body 12 in substantially parallel and slightly spaced relation. The anchoring legs 20 comprise an upper leg 24 and a lower leg 26 each having a narrow region 22, which are coterminous such that, as the apparatus is anchored in the slot of a wall board, the narrow regions of both legs are received in the wall board B to reside therein. The upper leg 24 further has an upwardly extending finger 28 located at the distal end of the leg. The finger 28 is operably configured to provide a shoulder 30 spaced from the longitudinal length of the upper leg. The shoulder 30 abuts against the interior of the wall board as weight is placed on the arm 14. The finger 28 extends for a first distance 32 from the upper leg at an angle, preferably ranging between approximately 30 degrees to 60 degrees from the longitudinal length of the upper leg and then reverses direction at an approximately perpendicular angle for a second distance 34 to the shoulder 30. This defines a notch, generally indicated at 36, between the shoulder and the upper leg. The distal wall 38 of the finger 28 is arcuately shaped as will be explained in greater detail below.

The lower leg 24 has a downwardly extending shoulder 37 that engages the interior of the wall board for a snug fit. The distal edge 40 of the lower leg is likewise arcuately shaped and the arc is substantially continuous with the distal portion of the upper leg.

Figure 2:
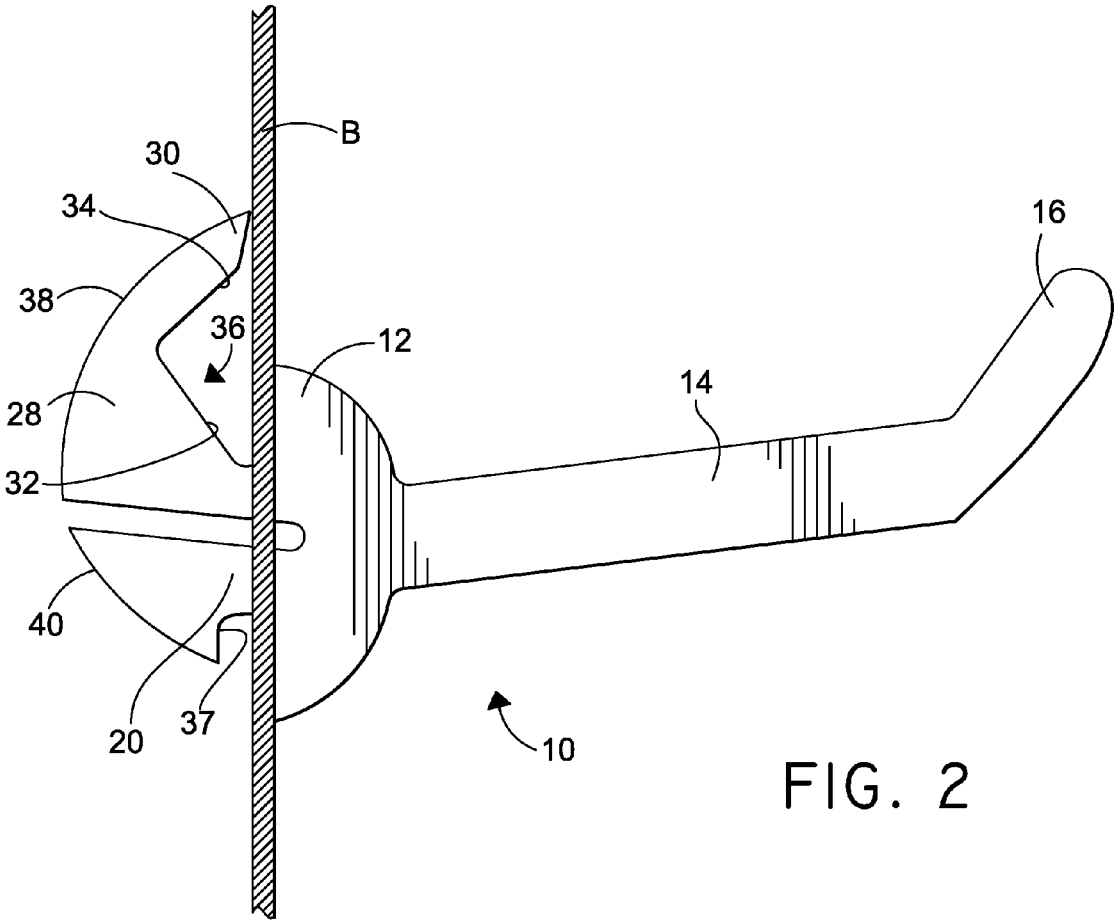
FIG. 2 is a side elevational view of the hanging apparatus as installed in a wall board.

It will be seen in FIG. 2 that the arcuate distal portion of the pair of arms has a center of curvature of its arc at or near the juncture of the finger 28 and the upper leg 24 of the apparatus. This curvature of the distal portion of the pair of legs in combination with the formed notch of the upper leg enables the finger 28 of the upper leg to be inserted into the slot of wall board B with the arm of the apparatus extending generally upwardly in the insertion position. The arm is then moved downwardly as the lower leg 26 of the apparatus is inserted in the slot. Upon insertion, the arm is extending outwardly generally perpendicularly to the wall board.

As previously described, the apparatus preferably is made of a pliable plastic. It will be seen in FIG. 3 that the apparatus may be locked in place by bending the upper leg's finger 28 in one direction and the lower leg's shoulder 37 in an opposite direction. Further, the arm 14 of the apparatus is likewise bendable into numerous configurations. It should also be understood that more than one hanger may be used in a single slot. This provides for a multi-arm projection from a single slot. Bending each arm in two locations allows each arm to be spaced from the other arm while extending generally perpendicularly from the wall board B.

Figure 3:
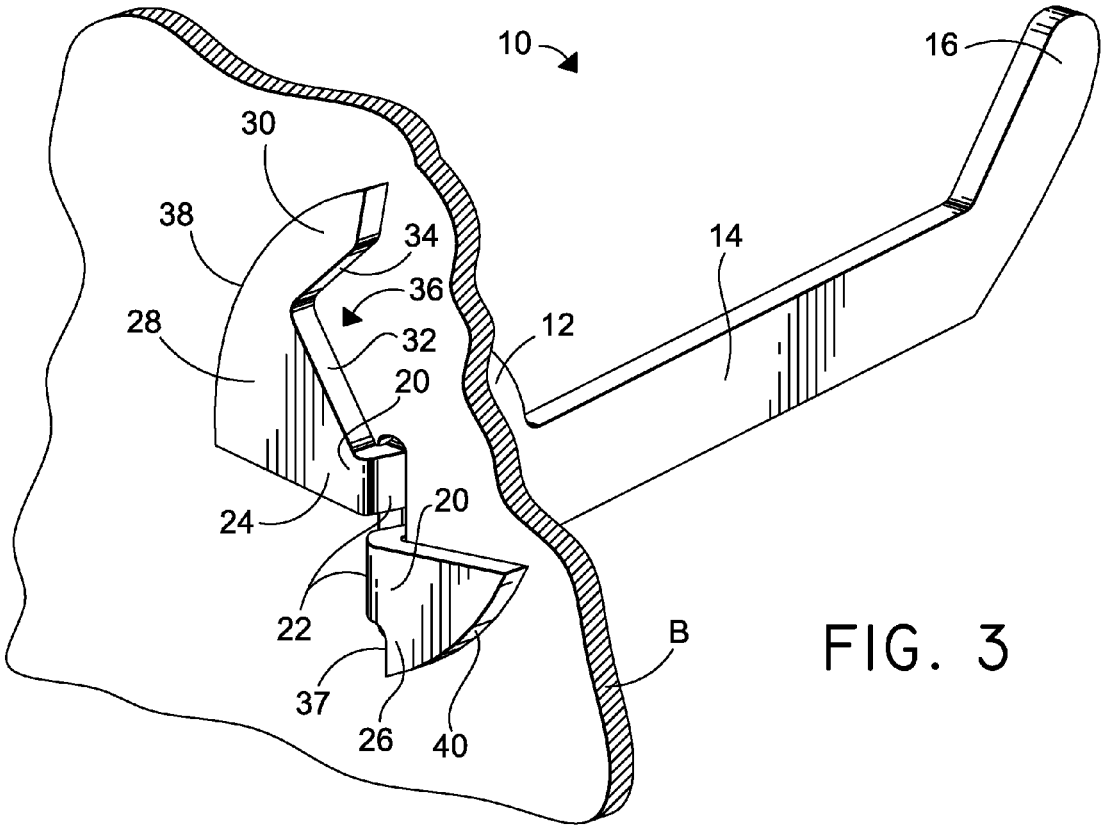
FIG. 3 is a side elevational view of the hanging apparatus illustrating the upper and lower legs manipulated.

FIG. 3 illustrates the apparatus of FIGS. 1 and 2 installed into the wall board B. The upper leg 24 is bent flush to the wall board B and the lower leg 26 is bent flush to the wall board B in the opposite direction of the upper leg 24. Manipulating the upper and lower legs of the apparatus gives further support for sustaining objects to be placed on the arm 14 of the apparatus. The illustration of the manipulation of the upper and lower legs of the apparatus is merely for illustrative purposes. The legs could be manipulated in any number of ways and are not limited to this illustration.

Figure 4:
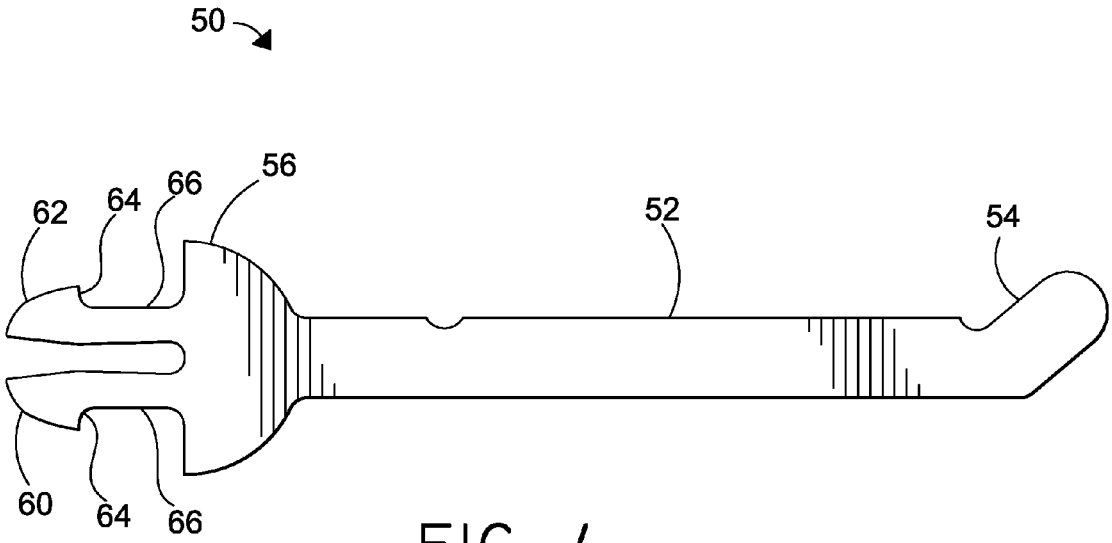
FIG. 4 is a side elevational view of another embodiment of the hanging apparatus.

FIG. 4 illustrates another embodiment of the present invention, shown generally at 50. The hanger 50 comprises a body 56, an arm 52 extending longitudinally outwardly from the body, and a pair of anchoring legs 60, 62 extending generally longitudinally outwardly from the body in an opposite direction from the arm 52. The arm 52 extends for a desired length from the body of the hanger 50 and preferably terminates in a hook 54 or other upwardly extending configuration to aid in retaining objects on the arm 52.

The anchoring legs 60, 62 extend from the body 56 in substantially parallel and slightly spaced relation. The anchoring legs comprise an upper leg 62 and a lower leg 60 each having a narrow region 66, which are coterminous such that, as the apparatus is anchored in the slot of a wall board, the narrow regions of both legs are received in the wall board to reside therein. The expanded end 64 of the upper and lower leg each define a shoulder to retain the hanger 50 in the wall board.

The wall board B may be any expanded PVC Vinyl such as Komatex® or Sintra®. It should be understood that the apparatus may be used in a variety of materials, such as foamcore, gatorfoam, MDF, pressed wood panels, pegboard, styrene, and others. The board must have a sufficient rigidity to support the materials on the apparatus and must have one or more slots formed therein. The slot may be of any size. If two hanging apparatus are to be used, the width may be expanded to accommodate the hangers.

It should be understood that the arm of the hanging fixture may be of any length and any configuration. The arm does not need to terminate in a free end. For example, the arm may be configured such that the both ends of the fixture terminate in anchoring legs. In this configuration, the hanging fixture may be used as a step or a support.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed:

1. An apparatus for insertion into a board having a slot to enable items to be hung thereon, the apparatus comprising:

a body having a first surface that faces a board having a slot in which the apparatus is installed and the body having a second surface opposite the first surface;

an upper leg extending from the first surface of the body in a first direction, the upper leg having an installation configuration and a locked configuration;

a finger disposed along the length of the upper leg and including a first portion and a second portion, in the installation configuration the first portion extending away from the body and at a first upward angle for a first distance, the second portion extending from a distal end of the first portion a second distance at a second upward angle that is substantially perpendicular to the first upward angle and toward a rear surface of the board, the second portion terminating in a shoulder configured to abut the rear surface of the board, and the upper leg and the finger forming a notch configured to receive an edge of the slot in the board and allow rotation of the body about the edge during installation of the apparatus in the slot, and the finger being bent at a junction of the finger and the upper leg to place the finger in a locked configuration, the finger being bent in a direction that is substantially perpendicular to the length of the upper leg to place the finger substantially flush against the rear surface and extending substantially parallel to the rear surface of the board; and a lower leg, separate from the upper leg, in the installation configuration extending from the first surface of the body in the first direction and having a shoulder extending downwardly from said lower leg, and the lower leg being bent along the length of the lower leg in a direction opposite that of the finger to place the lower leg in the locked configuration, the lower leg being substantially flush against the rear surface and extending substantially parallel to the rear surface of the board in the locked configuration, the upper and lower legs in the installation configuration being configured for insertion of both the upper and lower legs into a single slot in the board to thereby independently secure the body to the board without the aid of another component.

2. The apparatus of claim 1, wherein the apparatus is made of plastic and is sufficiently pliable to be bent into different configurations.

3. The apparatus of claim 1, wherein the first upward angle is between approximately 30 degrees to 60 degrees from the longitudinal length of the upper leg.

4. An apparatus for insertion into a board having a slot to enable items to be hung thereon comprising:

a body having a first surface that faces a board having a slot in which the apparatus is installed and the body having a second surface opposite the first surface;

an arm that extends a desired length from the second surface of the body; and an upper leg and a lower leg each having an arcuate distal edge, the upper leg and lower leg, in a first position, extending generally longitudinally outwardly from the first surface of the body in an opposite direction from the arm, the upper and lower legs being in spaced relation and configured for insertion of both the upper and lower legs into the slot in the board, and the upper and lower legs each being bent in opposite directions and substantially perpendicularly to the length of the arm to place the upper and lower legs in a second position in which the upper and lower legs are positioned substantially flush against a rear surface of the board and extend substantially parallel to the rear surface of the board.

5. The apparatus of claim 4, wherein the upper leg comprises an upwardly extended finger located at the distal end of the upper leg, the finger having a shoulder spaced from the longitudinal length of the upper leg.

6. The apparatus of claim 5, wherein the finger extends for a first distance from the upper leg at an angle and extends for a second distance from the first distance at an approximately perpendicular angle to define a notch.

7. The apparatus of claim 4, wherein the arm preferably terminates in a hook or other upwardly extending configuration to aid in retaining objects on the arm.

* * * * *